US005288259A

United States Patent [19]

Konta et al.

[11] Patent Number: 5,288,259

[45] Date of Patent: Feb. 22, 1994

[54] DOLL WITH ILLUMINATED HAIR

[75] Inventors: Yukio Konta, Chiba; Sachiko Kitajima, Kanagawa, both of Japan; Peter C. Lancaster, Buckinghamshire, United Kingdom

[73] Assignee: Sente Creations Co., Ltd., Tokyo, Japan

[21] Appl. No.: 946,394

[22] Filed: Sep. 17, 1992

[30] Foreign Application Priority Data

Sep. 20, 1991 [JP] Japan ..... 3-075904[U]
Nov. 4, 1991 [GB] United Kingdom ..... 9123306

[51] Int. Cl.[5] ..... A63H 33/22; A63H 3/44; A63H 33/26

[52] U.S. Cl. ..... 446/219; 446/394; 446/485; 362/32; 362/808

[58] Field of Search ..... 446/219, 372, 385, 391, 446/394, 485; 362/32, 806, 808

[56] References Cited

U.S. PATENT DOCUMENTS

| | | | |
|---|---|---|---|
| 2,933,853 | 4/1960 | Laval, Jr. | 446/485 X |
| 3,704,542 | 12/1972 | Suchowski | 446/394 X |
| 3,758,771 | 9/1973 | Frohardt et al. . | |
| 3,791,068 | 2/1974 | Pietrowiak | 446/394 X |
| 4,279,089 | 7/1981 | Murakami | 362/806 X |
| 4,298,915 | 11/1981 | Goldfarb et al. . | |
| 4,622,771 | 11/1986 | Spengler | 446/219 X |
| 4,781,647 | 11/1988 | Doane, Jr. . | |
| 4,875,144 | 10/1989 | Wainwright | 362/32 X |
| 4,878,873 | 11/1989 | Yamaguchi et al. | 446/219 X |
| 4,998,186 | 3/1991 | Cocca | 362/32 X |
| 5,037,346 | 8/1991 | Cimock | 446/419 |
| 5,052,969 | 10/1991 | Smith | 446/485 X |
| 5,118,319 | 6/1992 | Smith et al. | 446/219 |

*Primary Examiner*—David N. Muir
*Attorney, Agent, or Firm*—Salter, Michaelson & Benson

[57] ABSTRACT

A toy doll or toy animal having simulated hair at least some of which is formed by optical fibres. The optical fibres extend into the toy doll's or toy animal's body. A light source is positioned within the body so that light from the source is coupled into the optical fibres.

11 Claims, 3 Drawing Sheets

VIEW ON A

DOLL WITH ILLUMINATED HAIR

FIELD OF THE INVENTION

The invention relates to a toy doll or animal.

There is a continuing need to develop toy dolls or animals which present attractive effects to the user, particularly young children.

SUMMARY OF THE INVENTION

In accordance with the present invention, a toy doll or toy animal has simulated hair at least some of which is formed by optical fibres, the optical fibres extending into the toy doll's or toy animal's body; and light generating means including a light source positioned within the body so that light from the source is coupled into the optical fibres.

This new toy enables a number of attractive effects to be achieved. Use is made of the natural similarities between optical fibres and simulated hair to incorporate optical fibres and thus enable various light effects to be achieved. Preferably, the toy's hair comprises a mixture of optical fibres and other, non-optical fibres so that the light effects are mixed into the toy's hair.

Typically, the light generating means includes a switch mounted on or in the toy's body and preferably the switch is activated by moving a part of the toy's body. This part could be any suitable moving part of the toy such as a leg but, in the case of a doll, is preferably an arm of the doll. The switch can take a variety of forms but in the preferred example, comprises a micro switch or pair of contacts.

The light generating means preferably also includes a power source such as a battery mounted in or on the toy's body. This enables the toy to be self-contained.

In some examples, the light coupled into the optical fibres is monochromatic and of constant intensity while the source is active. More attractive effects can be achieved if the light generating means includes means for varying the light coupled into the optical fibre. For example, this variation might be a variation in light intensity or preferably a variation in colour. To this end, the light generating means preferably includes a multi-coloured filter which is movable to bring differently coloured filters in series between the light source and the optical fibres. This movement could be achieved by coupling the filter to a drive motor but is preferably achieved by movement of part of the toy's body, for example rotating a limb such as an arm or leg in the case of a doll. Where a switch is provided which is activated by moving part of the toy's body, it is preferred that the same part of the toy's body is used both to activate the switch and to cause movement of the multi-coloured filter.

The multi-coloured filter could comprise a multi-coloured disc but in the preferred arrangement is substantially cylindrical and surrounds the light source. In this case, the filter is rotated around the light source. Preferably, where this rotation is caused by rotation of a part of the toy's body, the filter is coupled to the rotating part of the toy's body by suitable gearing such that 180° rotation of the part causes a 360° rotation of the filter.

Although the invention is primarily concerned with toy dolls of human form, it is also applicable to toy animals in general, for example toy horses. In that application, optical fibres could be included in the horse's mane or tail, for example.

BRIEF DESCRIPTION OF THE DRAWINGS

An example of a toy doll according to the invention will now be described with reference to the accompanying drawings, in which.

DETAILED DESCRIPTION OF THE EMBODIMENT

Figure 1:
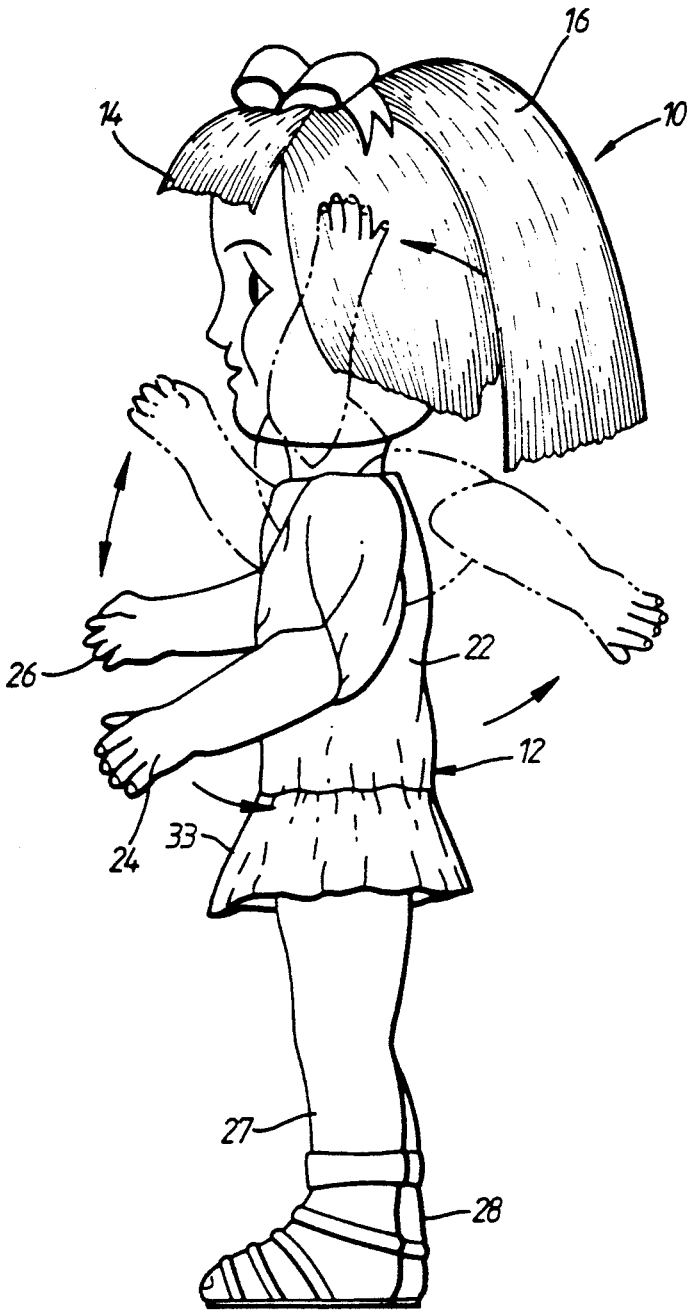
FIG. 1 is a side elevation of the doll.
Figure 8:
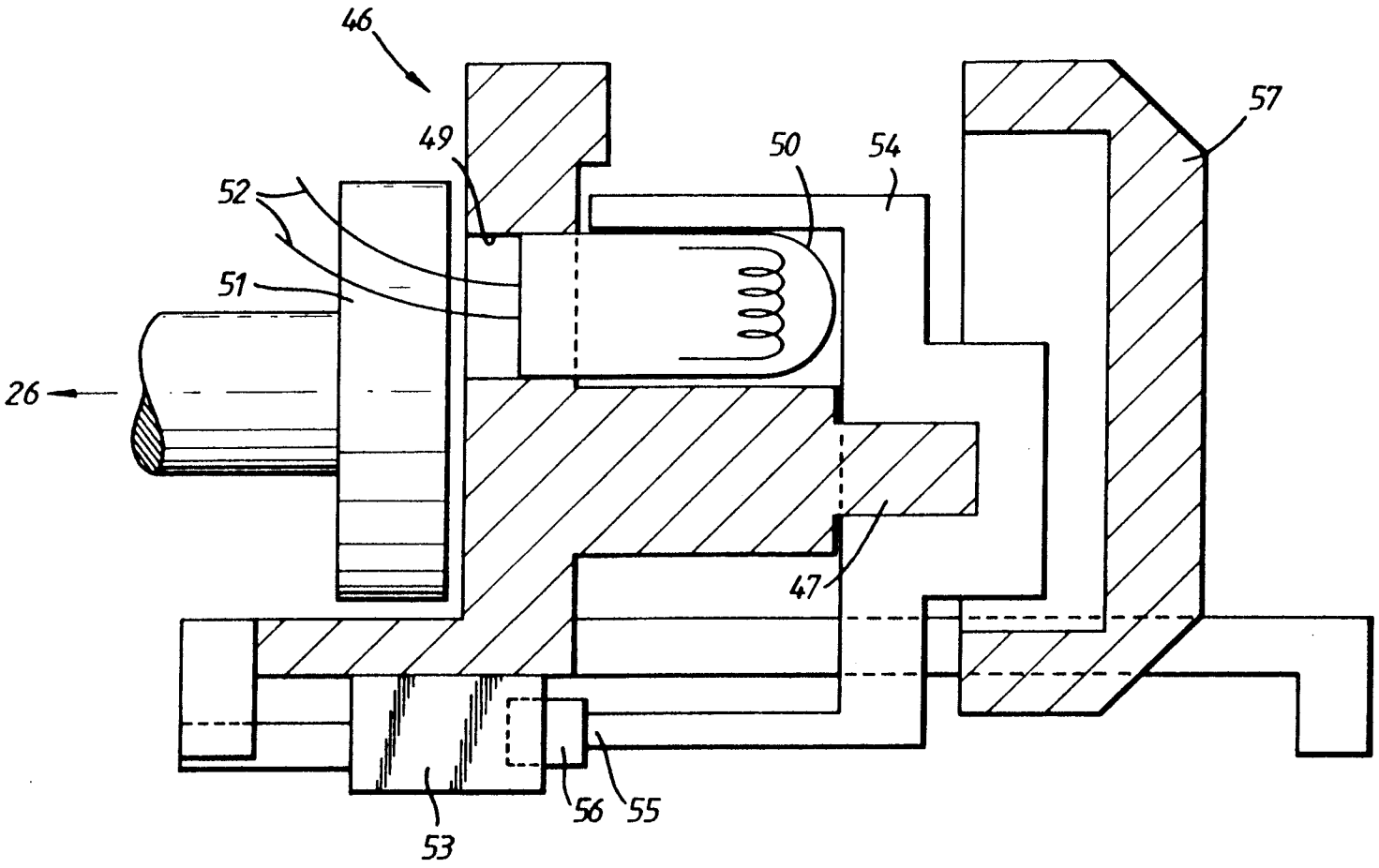
FIG. 8 is an enlarged view of the light generating mechanism.

The doll is generally indicated at 10 in FIG. 1 and comprises a doll body 12 including a head portion 14. The body 12 is of conventional construction and is typically moulded from a suitable rigid or semi-rigid plastics material in a suitable flesh tone colour. The body 12 includes, a torso portion 22 to which left and right arms 24,26 and left and right legs 27,28 are pivotally attached. The left and right arms 24,26 are secured to respective left and right mounting discs, one 51 of which is shown in FIG. 8, and which are rotatably received in apertures in the torso portion 22 and the left and right legs 27,28 are secured to the torso portion 22 in a similar manner. The head portion 14 is also pivotally attached to the torso portion 22. The doll is provided with suitable clothing 33.

The doll's hair 16 is formed of a mixture of optical and non-optical fibres distributed amongst one another in a relatively even manner.

Figure 2:
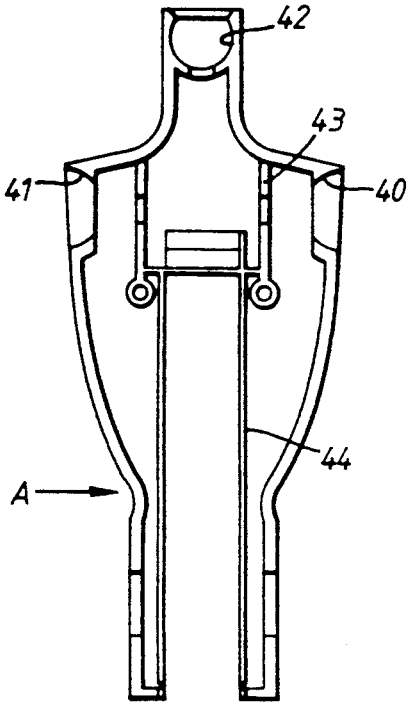
FIG. 2 is an internal view of the rear torso of the doll.
Figure 3:
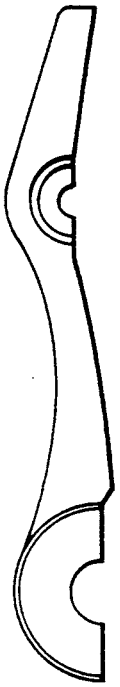
FIG. 3 is a view taken in the direction A of FIG. 2.
Figure 4:
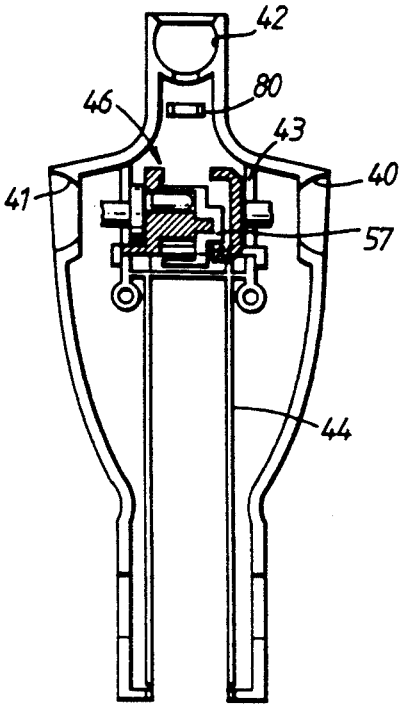
FIG. 4 is a view from the front of the rear torso with the light generating mechanism installed.
Figure 6:
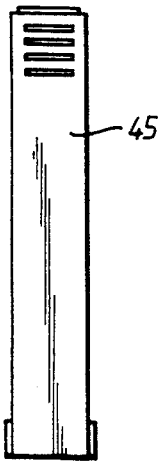
FIG. 6 is a plan of the battery cover.
Figure 7:
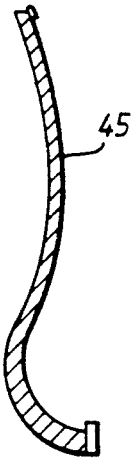
FIG. 7 is a longitudinal section through the battery cover of FIG. 6.

The torso portion 22 is formed of front and rear sections, the rear section being shown in FIGS. 2–4. The rear section includes a pair of semi-circular apertures 40,41 in which are received the left and right arms 24,26 respectively. The rear torso section also includes a semi-spherical receptacle 42 for receiving the neck plug to be described below. It is to be understood that the front torso section generally corresponds and is the mirror image of the rear torso section so it will not be described in detail. The front torso section houses a cleat retainer 80 whose position is illustrated in FIG. 4 for convenience. Both the front and rear torso sections are blackened internally and include a first housing portion 43 for supporting the light generating mechanism to be described below and a second housing portion 44 for supporting one or more batteries and battery contacts (not shown). The second housing portion 44 opens through the rear of the rear torso section and is closed by the battery cover 45 shown in FIG. 6. The battery cover has a curved form as shown in FIG. 7 which conforms to the curvature of the rear torso section as shown in FIG. 3.

The light generating mechanism is shown in FIG. 4 and in more detail in FIG. 8. The mechanism includes a support member 46 and a pinion 47. The support member 46 also includes a bore 49 to which is mounted a light bulb 50. The light bulb is connected in a conventional manner to an electrical circuit (not shown) via wires 52, the electrical circuit including the batteries supported in the second housing section 44 and a micro switch 53. Instead of the micro switch, a pair of flexible contacts could be used. The micro switch 53 is also mounted to the support member 46.

A transparent filter wheel 54 is rotatably mounted to the pinion 47. The filter wheel 54 has a number of differently coloured filters around its circumference and is rotatable about the pinion 47 to bring these filters in series between the bulb 50 and a cleat 61 mounted in the retainer 80. In this way, the light passing from the bulb 50 to the cleat 61 varies in colour as the filter wheel 54 rotates. The wheel 54 also carries a cam section 55 extending around part of its circumference but which is recessed at a position not shown. As the wheel 54 rotates, the cam section 55 pushes a switch member 56 of the micro switch 53 inwardly to activate the micro switch and thus cause the bulb 50 to light. When the recessed portion of the filter wheel 54 is aligned with the switch member 56, the switch member 56 can return to its rest position (not shown) thus breaking the circuit and switching the light off.

Rotation of the filter wheel 54 is achieved via a gear 57 rotatably mounted in the first housing portion 43 and attached to an axle connecting with the left arm 24 of the doll.

Thus, to activate the light, the left arm 24 is rotated causing rotation of the gear 57 and hence rotation of the filter wheel 54. This rotation causes the cam section 55 to engage the switch member 56 thus activating the micro switch 53 and causing the light 50 to light. Further rotation causes different parts of the filter wheel to be interposed between the bulb 50 and the cleat 61 so that the light received by the cleat 61 varies in colour. The arm can either be rotated through a full 360° or to and fro through 180°.

Figure 9:
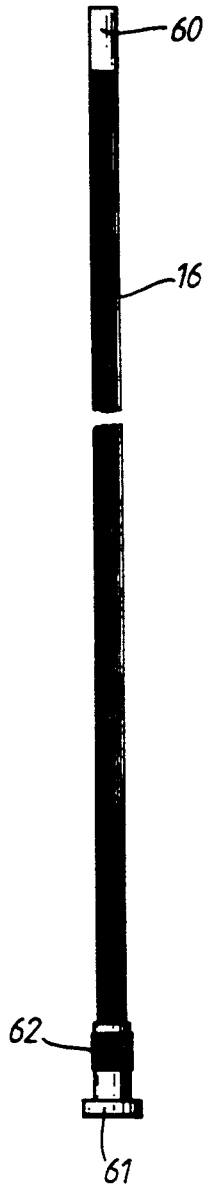
FIG. 9 illustrates the optical fibre arrangement prior to insertion into the doll.
Figure 5:
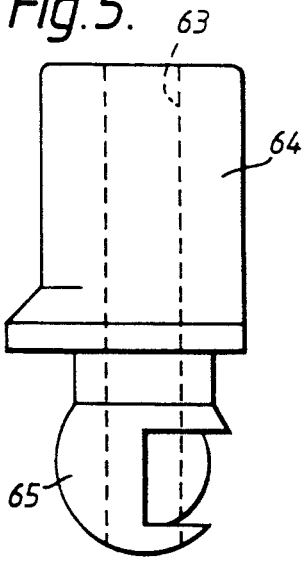
FIG. 5 illustrates the neck plug.

Initially, prior to assembly, the optical fibres 16 are held in a tight bundle (FIG. 9) between an end sleeve 60 and the, cleat 61 into which the fibres are clamped by a crimp 62. During manufacture, the fibres are engaged in the cleat retainer 80 until the flange of the cleat 61 is adjacent the bulb 50. The end sleeve is threaded through a bore 63 in a neck plug 64 (FIG. 5), the neck plug 64 having a ball joint 65 which is received in the receptor 42. The head portion 14 is fixed to the body of the neck plug 64 and is thus able to rotate to left and right and also to some extent up and down due to the rotatable nature of the connection between the ball joint 65 and the receptor 42. Once the fibres have been threaded through the bore 63 they extend through a hole (not shown) in the top of the head portion 14 and then out through that hole as shown in FIG. 1. The end sleeve 60 is then removed and the individual optical fibres are distributed amongst the remainder of the hair 16.

In operation, as explained above, when the arm 24 is rotated the light 50 is switched on and various different colours are coupled through the optical fibres 16 and will appear to the user to cause highlights of different colours to appear in the doll's hair.

We claim:

1. A doll comprising:

a body portion including a moveable body portion;

a plurality of simulated hair fibers arranged on said body portion;

a plurality of optical fibers which are intermixed with said simulated hair fibers so as to be evenly distributed therethrough;

a light source positioned within said body portion, said optical fibers extending into said body portion so that a light receiving end of said optical fibers is positioned adjacent to said light source;

power means positioned in said body portion for supplying electrical energy to said light source; and switch means coupled to said moveable body portion for selectively energizing and de-energizing said light source as said moveable body portion is displaced.

2. The doll of claim 1 further comprising filter means for varying a color of said light source, said filter means being positioned between said light source and said receiving end of said optic fibers.

3. In the doll of claim 2, said filter means comprising a rotatable filter having a plurality of differently colored filter portions, and means for rotating said filter means so that said differently colored filter positions are sequentially rotated between said light source and said receiving end of said optic fibers.

4. In the doll of claim 3, said filter means comprising a cylinder having a transparent sidewall, said sidewall including said plurality of differently colored filter portions, said cylinder being rotatably mounted in said body portion so that said transparent sidewall is positioned between said light source and said receiving end of said optic fibers.

5. The doll of claim 1 further comprising a plurality of appendages which are rotatably assembled with said body portion, said switch means being coupled to one of said rotatable appendages so that said light source is energized along a predetermined rotational arc of said appendage.

6. The doll of claim 3 further comprising a plurality of appendages which are rotatably assembled with said body portion, said switch means being coupled to one of said rotatable appendages so that said light source is energized at a predetermined rotational position of said appendage, and said means for rotating said filter comprising gear means coupled to one of said rotatable appendages wherein rotation of said appendage causes a simultaneous rotation of said filter means.

7. A doll comprising:

a body portion;

first and second arm members rotatably assembled with said body portion;

a head portion;

a plurality of simulated hair fibers arranged on said head portion;

a plurality of optic fibers which are intermixed with said simulated hair fibers so as to be evenly distributed throughout said hair fibers;

a light source positioned within said body portion adjacent to said head portion, said optic fibers extending into said body portion through said head portion so that a light receiving end of said optic fibers is positioned adjacent to said light source power means positioned in said body portion for supplying electrical energy to said light source; and switch means for selectively energizing and de-energizing said light source, said switch means being coupled to said first rotatable arm member so that said light source is energized along a predetermined rotational arc of said arm member.

8. The doll of claim 7 further comprising filter means for varying a color of said light source, said filter means being positioned between said light source and said receiving end of said optic fibers.

9. In the doll of claim 8, said filter means comprising a rotatable filter having a plurality of differently colored filter portions, and means for rotating said filter means so that said differently colored filter positions are sequentially rotated between said light source and said receiving end of said optic fibers.

10. In the doll of claim 9, said filter means comprising a cylinder having a transparent sidewall, said sidewall including said plurality of differently colored filter portions, said cylinder being rotatably mounted in said body portion so that said transparent sidewall is positioned between said light source and said receiving end of said optic fibers.

11. In the doll of claim 9, said means for rotating said filter comprising gear means coupled to one of said first rotatable arm member wherein rotation of said first rotatable arm member causes said light source to be energized and said filter to be rotated.

* * * * *